US006493674B1

(12) United States Patent
Takamizawa

(10) Patent No.: US 6,493,674 B1
(45) Date of Patent: Dec. 10, 2002

(54) CODED SPEECH DECODING SYSTEM WITH LOW COMPUTATION

(75) Inventor: Yuichiro Takamizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/130,044

(22) Filed: Aug. 6, 1998

(51) Int. Cl.[7] ..... G10L 19/00
(52) U.S. Cl. ..... 704/501; 704/502
(58) Field of Search ..... 704/500–504

(56) References Cited

U.S. PATENT DOCUMENTS

| | | | | |
|---|---|---|---|---|
| 5,363,096 A | * | 11/1994 | Duhamel et al. | 341/50 |
| 5,394,473 A | * | 2/1995 | Davidson | 381/36 |
| 5,444,741 A | * | 8/1995 | Mahieux | 375/254 |
| 5,752,225 A | * | 5/1998 | Fielder | 704/229 |
| 5,758,020 A | * | 5/1998 | Tsutsui | 395/213 |
| 5,812,982 A | * | 9/1998 | Chinen | 704/229 |
| 5,819,212 A | * | 10/1998 | Matsumoto et al. | 704/219 |
| 5,970,443 A | * | 10/1999 | Fujii | 704/222 |

FOREIGN PATENT DOCUMENTS

| | | |
|---|---|---|
| JP | 7-199993 | 8/1995 |
| JP | 9-252254 | 9/1997 |

OTHER PUBLICATIONS

"ATSC Doc. A/52", Digital Audio Compression Standard (AC–3), Advanced Television Systems Committee, Nov. 1994.

* cited by examiner

*Primary Examiner*—Fan Tsang
*Assistant Examiner*—Michael N. Opsasnick
(74) *Attorney, Agent, or Firm*—Ostrolenk, Faber, Gerb & Soffen, LLP

(57) ABSTRACT

In a coded speech decoding system, an n-channel time domain speech signal is converted to a frequency domain speech signal. A predetermined weighting adding process is executed on the frequency domain speech signal for each of a plurality of different transfer functions. The frequency domain speech signal obtained through the weighting adding process is converted to an m-channel (m<n) time domain speech signal. A predetermined windowing processing is executed on the time domain speech signal.

20 Claims, 4 Drawing Sheets

CODED SPEECH DECODING SYSTEM WITH LOW COMPUTATION

BACKGROUND OF THE INVENTION

The present invention relates to coded speech decoding systems and, more particularly, to a method of decoding coded speech with less computational effort than in the prior art in case when the number of channels of speech signal that a coded speech decoder outputs is less than the number of channels that are encoded in a coded speech signal.

Heretofore, multi channel speech signals have been coded and decoded by, for instance, a system called "Dolby AC-3". "Dolby AC-3" techniques are detailed in "ATSC Doc. A/52", Advanced Television Systems Committee, November 1994 (hereinafter referred to as Literature Ref. 1, and incorporated herein in its entirety).

The prior art coded speech decoding system will first be briefly described. In the prior art coded speech decoding system, input speech signal is first converted through an MDCT (modified discrete cosine transform), which is in the mapping transform, to MDCT coefficients as frequency domain. In this mapping transform, either one of two different MDCT functions prepared in advance is used depending on the character of speech signal to be coded. Which one of the MDCT functions is to be used is coded in auxiliary data. The MDCT coefficients thus obtained are coded separately as exponents and mantissas in the case of expressing in a binary number of floating point system. The mantissas are variable run length coded based on the importance of the subjective coding quality of the MDCT coefficients. Specifically, the coding is performed by using a larger number of bits for the mantissa of an MDCT coefficient with greater importance and a smaller number of bits for the mantissa of an MDCT coefficient with less importance. The exponents and mantissas obtained as a result of the coding and also the auxiliary data, are multiplexed to obtain the coded speech (in the form of a coded bit stream).

FIG. 3 is a block diagram showing a prior art coded speech decoding system. The illustrated prior art coded speech decoding system comprises a coded speech input terminal 1, a coded speech separating unit 2, an exponent decoding unit 3, a mantissa decoding unit 4, an assigned bits calculating unit 5, an IMDCT (inverse MDCT: mapping) unit 60 and a decoded speech output terminal 7. In the following description of operation of the prior art coded speech decoding system, a case is taken, in which coded speech, obtained as a result of coding of an n-channel speech signal, is decoded to an m-channel decoded speech signal. This process of converting a number n of coded audio channels to a smaller number m of decoded channels without loss of information is known in the art as downmixing (see Ref. 1, p. 82). It is used, for example to convert coded five-channel "surround" sound (n=5) to two-channel stereo (m=2), and the following description will be presented in terms of that application.

The coded speech signal obtained through the coding of the 5 channel speech signal is inputted to the coded speech signal input terminal 1. The coded speech signal inputted to the input terminal 1 is outputted to the coded speech signal separating unit 2.

The coded speech signal separating unit 2 separates the coded speech bit stream into exponent data, mantissa data and auxiliary data, and outputs these data to the exponent decoding unit 3, the mantissa decoding unit 4 and the IMDCT unit 4, respectively.

The exponent decoding unit 3 decodes the exponent data to generate 256 MDCT exponent coefficient per channel for each of the 5 channels. The generated exponent MDCT coefficient for the 5 channels are outputted to the assigned bits calculating unit 5 and the IMDCT unit 60. Hereinunder, the MDCT exponent coefficient of CH-th (CH=1, 2, . . . , 5) channel is referred to as EXP(CH, 0), EXP(CH, 1), . . . , EXP(CH, 255), and N in MDCT exponent coefficient EXP (CH, N) is referred to as frequency exponent.

The assigned bits calculating unit 5 generates assigned bits data for MAXCH channels in a procedure described in Literature Ref. 1, taking human's psychoacoustic characteristics into considerations, with reference to the MDCT exponent coefficient inputted from the exponent decoding unit 3, and outputs the generated assigned bits data to the mantissa decoding unit 4.

The mantissa decoding unit 4 generates the MDCT mantissa coefficients, each expressed as a floating point binary number, for the 5 channels.

The generated MDCT mantissa coefficients for the 5 channels are outputted to the IMDCT unit 60. Hereinunder, CH-th (CH=1, 2, . . . , 5) channel MDCT mantissa coefficients are referred to as MAN(CH, N), is referred to as the N'th frequency mantissa.

The IMDCT unit 60 first derives the MDCT coefficients from the MDCT mantissa coefficients and MDTC exponent coefficients. Then, the unit 60 converts the MDTC coefficients to the MAXCH-channel speech signal through IMDCT using the transform function designated by the auxiliary data and by windowing. Finally, the unit 60 converts the 5-channel speech signal to 2-channel decoded speech signal through weighting multiplification of the 5-channel speech signal by weighting coefficients each predetermined for each channel. The 2-channel decoded speech signal thus generated is outputted from the decoded speech signal output terminal 7.

FIG. 4 is a block diagram showing an example of the internal structure of the IMDCT unit 60 in the prior art coded speech signal decoding system when the number of the channels is 5.

MDCT exponent coefficient EXP(CH, N) of CH-th (CH=1, 2, . . . , 5) channel for N'th frequency exponent (N=0, 1, . . . , 255) is inputted to the input terminal 100.

MDCT mantissa coefficient MAN(CH, N) of CH-th (CH=1, 2,. . . , 5) channel for frequency exponent N (N=0, 1, . . . , 255) is inputted to the input terminal 101.

Auxiliary data including identification of transform function data of CH-th (CH=1, 2, . . . , 5) channel is inputted to the input terminal 102.

The MDCT exponent coefficient EXP(CH, N) and the MDCT mantissa coefficient MAN(CH, N) are outputted to an MDCT coefficient generator 110.

The MDCT coefficient generator 110 generates MDCT coefficient MDCT(CH, N) of CH-th (CH=1, 2, . . . , 5) channel for N'th frequency exponent (N=0, 1, . . . 255) by executing computational operation expressed as $$MDCT(\mathrm{CH}, N)=\mathrm{MAN}(\mathrm{CH}, N)\times 2\hat{}(_\mathrm{EXP}(\mathrm{CH}, N))$$

where X^Y represents raising X to power Y.

MDCT coefficient MDCT(CH, N) of the CH-th channel (CH=1, 2, . . . , 5) channel for frequency exponent N (N=0, 1, . . . , 255), is outputted to transform function selector 12-CH of CH-th channel (i.e., transform function selectors 12-1 to 12-5 as shown in FIG. 4).

Transform function selection data of the CH-th (CH=1, 2, . . . , 5) channel inputted to the input terminal 102, is outputted to the pertinent transform function selectors 12-CH. According to the transform function data of CH-th (CH=1, 2, . . . , 5) channel ,transform function selector 12-CH selects either a 512- or a 256-point IMDCT 22-CH or 23-CH for the CH-th channel as transform function to be used, and outputs CH-channel MDCT coefficient MDCT (CH, 0), MDCT(CH, 1), . . . , MDCT(CH, 225) to the selected MDCT function.

CH-channel 512-point IMDCT 22-CH, when selected for CH-th (CH=1, 2, . . . , 5) channel by the pertinent CH-channel transform function selector 12-CH, converts MDCT coefficient MDCT (CH, N) of CH-channel to windowing signal WIN(CH, N) of CH-channel for frequency exponent N (N=0, 1, . . . , 255) through 512-point IMDCT.

The windowing signal WIN(CH, N) of CH-th channel thus obtained is outputted to windowing processor 24-CH of CH-channel. At this time, 256-point IMDCT 23-CH of CH-channel is not operated and does not output any signal. 256-point IMDCT 23-CH of CH-channel, when selected by the pertinent CH-channel transfer function selector 12-CH, converts CH-channel MDCT coefficient MDCT (CH, N) for frequency exponent N (N=0, 1, . . . , 255) to CH-channel windowing signal WIN(CH, N) through 256-point IMDCT. At this time, CH-channel 512-point IMDCT 22-CH is not operated and does not output any signal.

The 512-point IMDCT 22-CH for CH-channel executes the 512-point IMDCT in the following procedure, which is shown in Literature Ref. 1. The 512-point IMDCT is a linear transform.

(1) The 256 MDCT coefficients to be converted are referred to X(0), X(1), . . . , X(255).

Also, $$x\cos 1(k)=-\cos(2\pi(8k+1)\div 4096)$$

and $$x\sin 1(k)=-\sin(2\pi(8k+1)\div 4096)$$

are set as such.

(2) Calculations on $$Z(K)=(X(225-2k)+j\times X(2k))\times(x\cos 1(k)+j\times\sin 1(k))$$

are executed for k=0, 1, . . . , 127.

(3) Calculations on $$z(n)=\sum_{0}^{127} z(k)\cdot(\cos(8\pi kn/N)+j\cdot\sin(8\pi kn/N)) \quad \text{(Formula 1)}$$

are executed for n=0, 1, . . . , 127.

(4) Calculations on $$y(n)=z(n)\times(x\cos 1(n)+j\times\sin 1(n))$$

are executed for n=0, 1, . . . , 127.

(5) Calculations on $$x(2n)=-yi(64+n),$$

$$x(2n+1)=yr(63-n),$$

$$x(128+2n)=-yr(n),$$

$$x(128+2n+1)=yi(128-n-1),$$

$$x(256+2n)=-yr(64+n),$$

$$x(256+2n+1)=yi(64-n-1),$$

$$x(384+2n)=yi(n)$$

and $$x(384+2n+1)=-yr(128-n-1)$$

where yr(n) and yi(n) are the real number and imaginary number parts, respectively, of y(n), are executed for n=0, 1, . . . , 127.

(6) Signals x(0), x(1), . . . , x(255) are outputted as windowing signal.

The 256-point IMDCT 23-CH of CH-channel executes the 256-point IMDCT in the following procedure, which is shown in Literature Ref. 1. This 256-point IMDCT is a linear transform.

(1) The 256 MDCT coefficients to be converted are referred to X(0), X(1), . . . , X(255).

Also, $$x\cos 2(k)=-\cos(2\pi(8k+1)\div 2048)$$

and $$x\sin 2(K)=-\sin(2\pi(8k+1)\div 2048)$$

are set as such.

(2) Calculations on $$X1(k)=X(2k)$$

and $$X2(k)=X(2k+1)$$

are executed for k=0, 1, . . . , 127.

(3) Calculations on $$Z1(k)=(X1(128-2k-1)+j\times X1(2k))\times(x\cos 2(k)+j\times x\sin 2(k))$$

and $$Z2(k)=(X2(128-2k-1)+j\times X2(2k)\times(x\cos 2(k)+j\times x\sin 2(k))$$

are executed for k=0, 1, . . . , 63.

(4) Calculations on $$z1(n)=\sum_{0}^{63} z1(k)\cdot(\cos(16\pi kn/512)+j\cdot\sin(16\pi kn/512) \quad \text{(Formula 2)}$$

and $$z2(n)=\sum_{0}^{63} z2(k)\cdot(\cos(16\pi kn/512)+j\cdot\sin(16\pi kn/512) \quad \text{(Formula 3)}$$

are executed for n=0, 1, . . . , 63.

(5) Calculations on $$y1(n)=z1(n)\times(x\cos 2(n)+j\times x\sin 2(n))$$

and $$Y2(n)=z2(n)\times(x\cos 2(n)+j\times x\sin 2(n))$$

are executed for n=0, 1, . . . , 63.

(6) Calculations on $$x(2n)=-yi1(n),$$

$$x(2n+1)=yr1(64-n-1),$$

$$x(128+2n)=yr1(n),$$

$$x(128+2n+1)=yi1(64-n-1),$$

$$x(256+2n)=-yr2(n),$$

$$x(256+2n+1)=yi2(64-n-1),$$

$$x(384+2n)=yi2(n)$$

and $$x(384+2n+1)=yr2(64-n-1)$$

where yr 1(n) and yi 1(n) are the real number and imaginary number parts, respectively, of y1(n), are executed for n=0, 1, . . . , 63.

(7) Signals x (0), x(1), . . . , x(255) are outputted as windowing signal.

Windowing processor 24-CH of CH-th (CH=0, 1, . . . , 5) channel converts windowing signal WIN (CH, N) (n=0, 1, . . . , 255) of CH-channel to speech signal PCM (CH, n) of CH-th channel by executing calculations on linear transform formulas $$PCM(\mathrm{CH},n)=2\times(\mathrm{WIN}(\mathrm{CH},n)\times(W(n)+\mathrm{DELAY}(\mathrm{CH},n)\times W(256+n))$$

and $$\mathrm{DELAY}(\mathrm{CH},n)=\mathrm{WIN}(\mathrm{CH},256+n)$$

where W(n) is a constant representing a window function as prescribed in Literature Ref. 1. DELAY(CH, n) is a storage area prepared in the decoding system, and it should be initialized once to zero when starting the decoding. The speech signal PCM(CH, n) of CH-channel thus obtained as a result of the conversion is outputted to a weighting adding processor 250.

The weighting adding processor 250 generates decoded speech signals LPCM(n) and RPCM(n) (n=0, 1, . . . , 255) of 1-st and 2-nd channel by executing calculations on $$LPCM(n)=\sum_{i=1}^{MAXCH} LW(i)\cdot PCM(i,N) \qquad \text{(Formula 4)}$$

and $$RPCM(n)=\sum_{i=1}^{MAXCH} RW(i)\cdot PCM(i,N) \qquad \text{(Formula 5)}$$

which are liner transform formulas. In this instance, LW(1), LW(2), . . . , LW(5) and RW(1), RW(2), . . . , RW(5) are weighting constants, which are described as constants in Literature Ref. 1. Decoded speech signals LPCM(n) and RPCM(n) of the 1-st and 2-nd channel are outputted from output terminals 26-1 and 26-2, respectively.

The prior art coded speech decoding system as described above, has a problem that it requires great IMDCT computational effort, because the IMDCT and the windowing are each executed once for each channel.

SUMMARY OF THE INVENTION

An object of the present invention is to provide a coded speech decoding system, which permits IMDCT with less computational effort.

According to the present invention, there is provided a coded speech decoding system comprising: a mapping transform means for converting a time domain speech signal having a fast number of channels n to m frequency domain bitstream; a weighting addition means for executing a predetermined weighting adding process on the frequency domain speech signal obtained in the mapping transform means to output a speech signal using channels in a second channel number; an inverse mapping transform means for converting the second channel number speech signal to a time domain speech signal; and windowing means for executing a predetermined windowing process on the time domain speech signal obtained in the inverse mapping transform means.

The mapping transform is modified discrete cosine transform, and the inverse mapping is modified inverse discrete cosine transform. When the inverse mapping transform is executed by using one of a plurality of preliminarily prepared different transform functions, the process of converting the channel number is executed for each transform function. If any transform function is not used for any of the n channels, the n to m channel conversion and the inverse mapping transform are not performed with the unused transform function.

According to another aspect of the present invention, there is provided a coded speech decoding system featuring converting a time domain speech signal having n channels to a frequency domain speech signal; executing a predetermined weighting adding process on the frequency domain speech signal for each of a plurality of different transfer functions; converting a speech signal obtained after the weighting adding process to a time domain speech signal, and executing a predetermined windowing process on the time domain speech signal thus obtained.

According to other aspect of the present invention, there provided a coded speech decoding apparatus comprising: MDCT coefficients generator for generating MDCT coefficients on the basis of channel MDCT exponent coefficient, channel MDCT mantissa coefficient and auxiliary data including channel transform function data; channel transform function selector for selecting one of a plurality of weighting processors according to a channel transform function data contained in the auxiliary data; weighting adder processor for executing a weighting adding process on the MDCT coefficients as frequency domain signal from the output of the channel transform function selector; IMDCT processor for executing IMDCT on the output signal from the weighting adder processor; channel adder for generating windowing signal on the basis of the output of the IMDCT processor; and window processor for converting the window signal from the channel adder into a speech signal.

According to still other aspect of the present invention, there provided a coded speech decoding method comprising the steps of: converting an n-channel time domain speech signal a frequency domain speech signal; executing a predetermined weight adding process on the frequency domain speech signal for each of a plurality of different transfer functions; converting the speech signal obtained through the weighting adding process to a time domain speech signal; and executing a predetermined windowing processing on the time domain speech signal.

Other objects and features will be clarified from the following description with reference to attached drawings.

PREFERRED EMBODIMENTS OF THE INVENTION

Preferred embodiments of the present invention will now be described with reference to the drawings.

Figure 1:
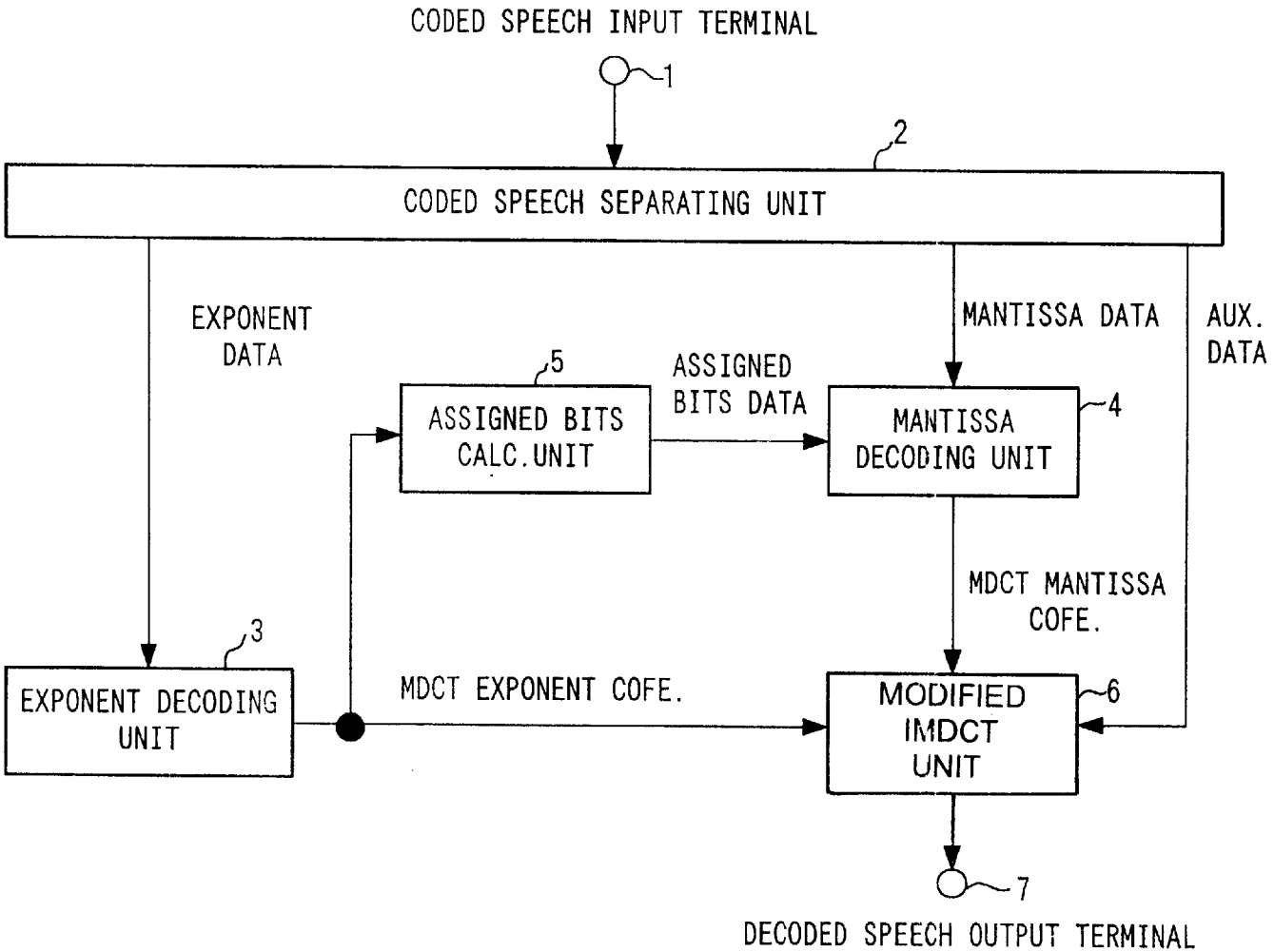
FIG. 1 is a block diagram showing an embodiment of the coded speech decoding system according to the present invention.
Figure 2:
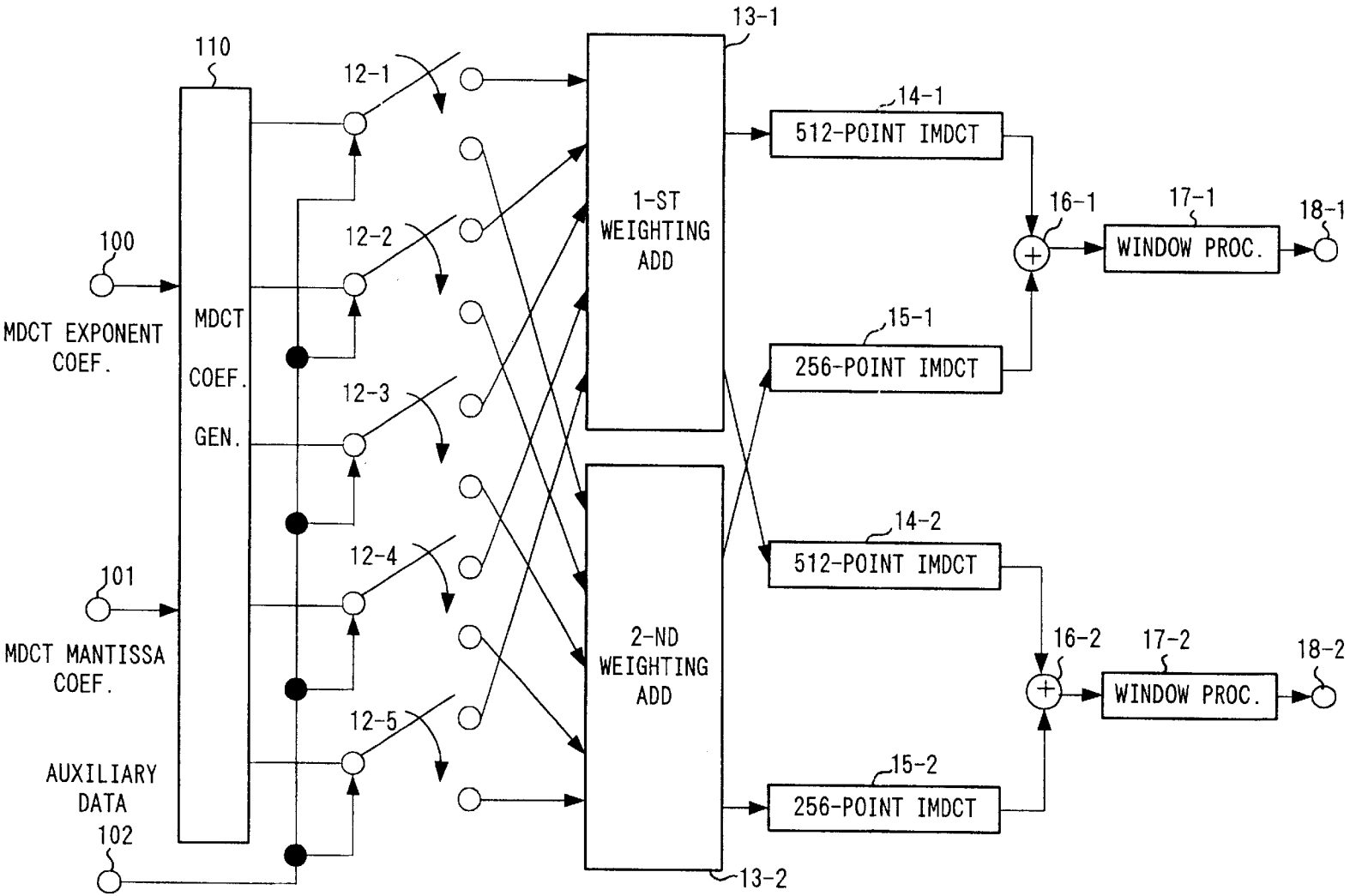
FIG. 2 is a block diagram showing the internal structure of modified IMDCT unit 6 in this embodiment of the coded speech decoding system.
Figure 3:
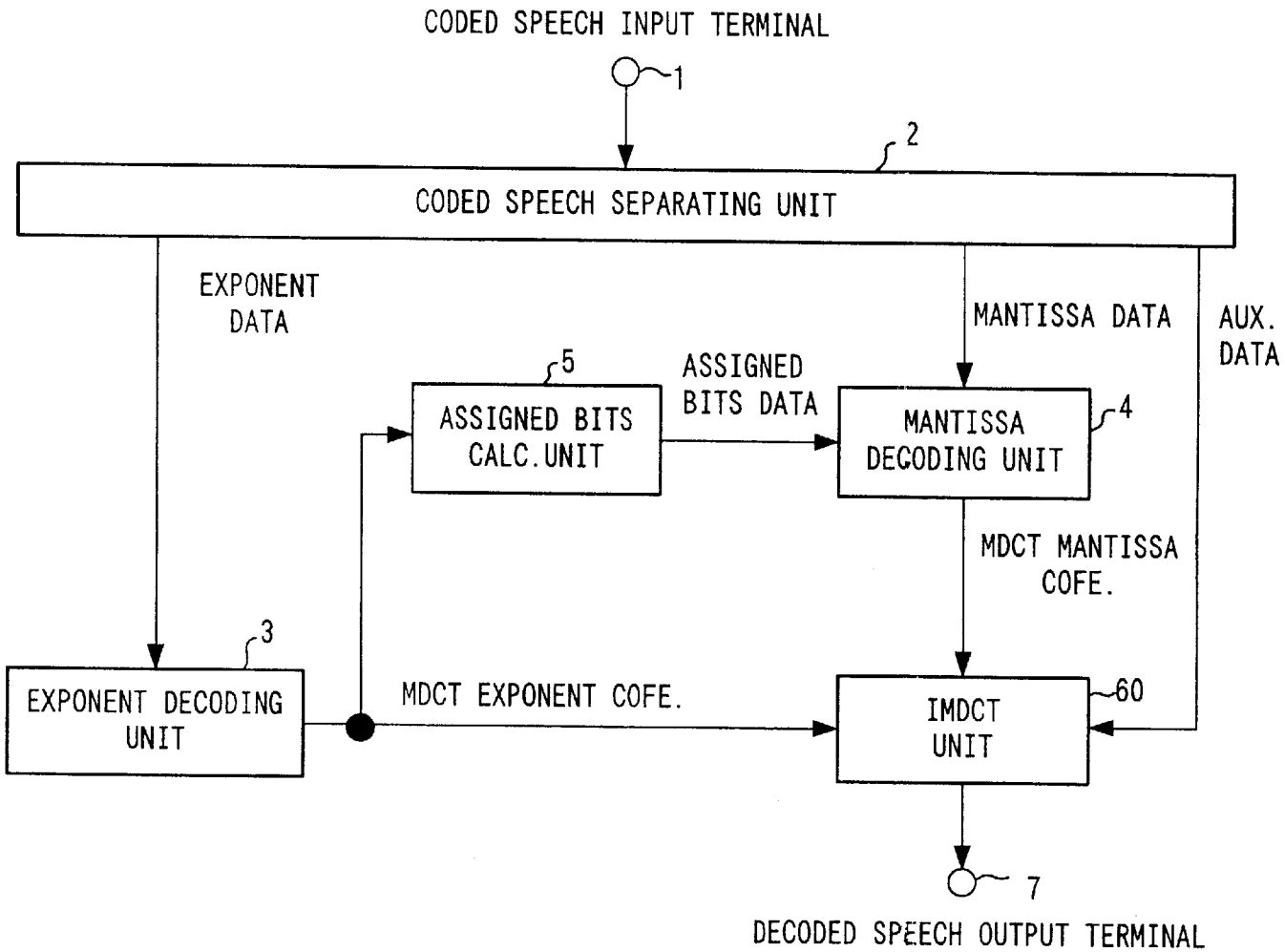
FIG. 3 PRIOR ART
FIG. 3 is a block diagram showing a prior art coded speech decoding system.

FIG. 1 is a block diagram showing an embodiment of the coded speech decoding system according to the present invention. This embodiment of the coded speech decoding system is different from the prior art coded speech decoding system shown in FIG. 3 in that it uses a modified IMDCT unit 6 in lieu of the IMDCT unit 60 in the prior art system. FIG. 2 is a block diagram showing the internal structure of the modified IMDCT unit 6 in this embodiment of the modified coded speech decoding system.

The operation of the IMDCT unit 6 shown in FIG. 1 will now be described in detail with reference to FIG. 2. Again, it will be assume that five coded channels (n=5) are to be downmixed to two channels (m=2).

The MDCT unit 6 comprises input terminals 100 to 102, an MDCT coefficient generator 110, a 1-st to a 5-th channel transform function selector 12-1 to 12-5, a 1-st and a 2-nd weighting adding processor 13-1 and 13-2, a 1-st and a 2-nd 512-point IMDCT 14-1 and 14-2, a 1-st and a 2-nd 256-point IMDCT 15-1 and 15-2, a 1-st and a 2-nd channel adder 16-1 and 16-2, a 1-st and a 2-nd windowing processor 17-1 and 17-2 and output terminals 18-1 and 18-2.

Like the prior art coded speech decoding system, MDCT coefficient exponent EXP(CH, N) (N=0, 1, . . . , 255) of CH-th (CH=1, 2, . . . , 5) channel is inputted to the input terminal 100.

Also, like the prior art coded speech decoding system, MDCT coefficient mantissa MAN(CH, N) (N=0, 1, . . . , 255) of CH-th (CH=1, 2, . . . , 5) channel is inputted to the input terminal 101.

Furthermore, like the prior art coded speech decoding system, auxiliary data including transform function data of CH-th (CH=1, 2, . . . , 5) channel, is inputted to the input terminal 102.

Like the prior art coded speech decoding system, MDCT exponent coefficient EXP(CH, N) and MDCT mantissa coefficient MAN(CH, N) are outputted to the MDCT coefficient generator 110.

Like the prior art coded speech decoding system, the MDCT coefficient generator 110 generates MDCT coefficient MDCT(CH, N) of CH-th (CH=1, 2, . . . , 5) channel for frequency exponent N (N=0, 1, . . . , 225) by executing calculations on a formula $$MDCT(\mathrm{CH}, N)=\mathrm{MAN}(\mathrm{CH}, N)\times 2^{\wedge}(-\mathrm{EXP}(\mathrm{CH}, N)).$$

Like the prior art coded speech decoding system,

The MDCT coefficient MDCT(CH, N) of CH-th (CH=1, 2, . . . , 5) channel for frequency exponent N (N=0, 1, . . . , 225) are outputted to respective transform function selector (i.e., transform function selectors 12-1 to 12-5 in FIG. 2).

Transform function selector 12-CH of CH-th (CH=1, 2, . . . , 5) channel selects either the 1-st or the 2-nd weighting processor 13-1 or 13-2 according to transform function data for the CH-th channel contained in the auxiliary data, and outputs MDCT coefficient MDCT(CH, 0), MDCT(CH, 1), . . . , MDCT(CH, 255) of CH-th channel to the selected weighting adder processor. The group of channels, for which the 1-st weighting adder processor 13-1 is selected, is defined as LONGCH. For example, when the 1-st weighting adder processor 13-1 is selected for the 1-st, 2-nd and 4-th channels, $$\mathrm{LONGCH}=\{1, 2, 4\}$$

The group of channels, for which the 2-nd weighting adding processor 31-2 is selected, is defined SHORTCH.

The 1-st weighting adder processor 13-1, executes the weighting adding process on MDCT coefficients as frequency domain signal instead of speech signal as time domain signal as in the prior art. Specifically, the 1-st weighting adder processor 13-1 generates (Formula 6)

$$\mathrm{LONG_MDCT}(1,N)=\Sigma LW(i)\cdot MDCT(i,N)i\epsilon\mathrm{LONGCH}$$

and (Formula 7)

$$\mathrm{LONG_MDCT}(1,N)=\Sigma LW(i)\cdot MDCT(i,N)i\epsilon\mathrm{LONGCH}$$

for frequency exponent N (N=0, 1, . . . , 255) from the input MDCT coefficient MDCT(CH, N), and outputs LONG_MDCT(1, N) to the 1-st 512-point IMDCT 14-1 and LONG-MDCT(2 N) to the 2-nd 512-point MDCT 14-2. In this instance, LW(1), LW(2), . . . , LW(5), and RW(1), RW(2), . . . , RW(5) are weighting adding coefficients which are described as constants in Literature Ref. 1.

The 2-nd weighting adder processor 13-2, unlike the prior art coded speech decoding system, also executes the weighting adding process on the MDCT coefficients as the frequency domain signal instead of speech signal as the time domain signal. Specifically, the 2-nd weighting adder processor 13-2 generates (Formula 8)

$$\mathrm{SHORT_MDCT}(i,N)=\Sigma LW(i)\cdot MDCT(i,N)i\epsilon\mathrm{LONGCH}$$

and (Formula 9)

$$\mathrm{SHORT_MDCT}(2,N)=\Sigma RW(i)\cdot MDCT(i,N)i\epsilon\mathrm{LONGCH}$$

for frequency exponent N (N=0, 1, . . . , 255) from the input MDCT coefficient MDCT(CH, N), and outputs SHORT_MDCT(1, N) and SHORT_MDCT(2, N) to the 1-st and 2-nd 512-point IMDCTs 14-1 and 14-2, respectively.

M-th (M=1, 2) 512-point MDCT 14-M executes the 512-point IMDCT on the input signal LONG_MDCT(M, N), and outputs LONG_OUT(M, N).

M-th (M=1, 2) 256-point MDCT 15-M executes the 256-point IMDCT on the input signal SHORT_MDCT(M, N), and outputs SHORT_OUT(M, N).

M-th (M=1, 2) channel adder 16-M generates windowing signal WIN(M, N) by executing calculations on the input signals LONG_OUT(M, N) and SHORT_OUT(M, N) using formulas $$\mathrm{WIN}(\mathbf{1}, N)=\mathrm{LONG_OUT}(\mathbf{1}, N)+SHORT_\mathrm{OUT}(\mathbf{1}, N)$$

and $$\mathrm{WIN}(\mathbf{2}, N)=\mathrm{LONG_OUT}(\mathbf{2}, N)+\mathrm{SHORT_OUT}(\mathbf{2}, N).$$

M-th (M=1, 2) windowing processor 17-M converts M-th channel windowing signal WIN(M, n) (n=0, 1, . . . , 225) to M-th channel speech signal PCM(M, n) by doing calculations $$PCM(M, n)=2\times(\mathrm{WIN}(M, n)\times W(n)+\mathrm{DELAY}(M, n)+W(256+n))$$

and $$\mathrm{DELAY}(M, n)=\mathrm{WIN}(M, 256+n)$$

where W(n) is a constant prescribed as a constant in Literature Ref. 1. DELAY(M, n) is a storage area prepared in the decoding system, and it should be initialized to zero once when starting the decoding. 1-st and 2-nd channel speech signals PCM(1, n) and PCM(2, n) are outputted to the output terminals 18-1 and 18-2, respectively.

Figure 4:
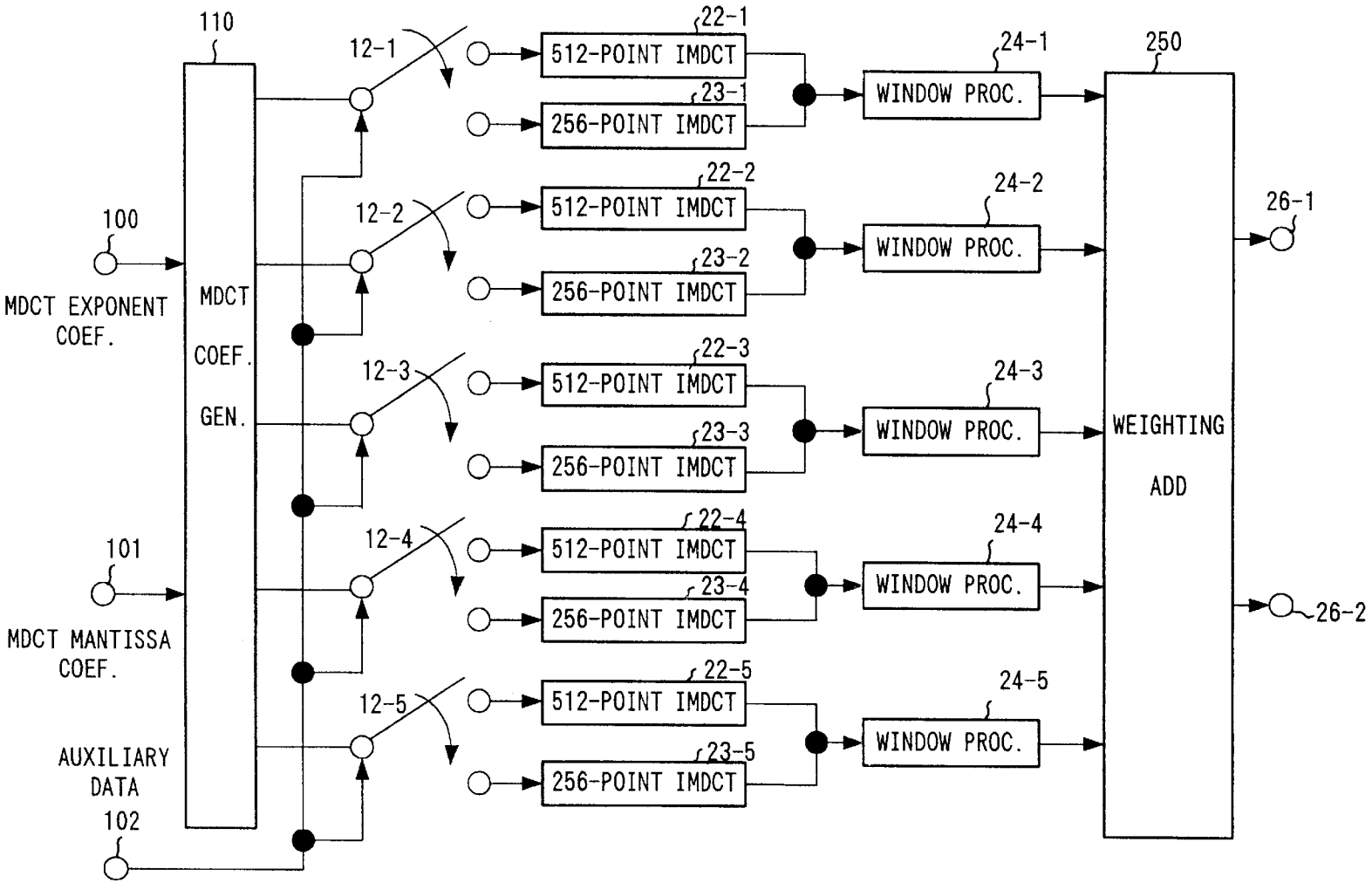
FIG. 4 PRIOR ART
FIG. 4 is a block diagram showing an example of the internal structure of the IMDCT unit 60 in the prior art coded speech signal decoding system.

In the prior art coded speech decoding system shown in FIG. 4, the processes for CH (CH=1, 2, . . . , 5) channel are executed in the order of the IMDCT (22-CH and 23-CH in FIG. 4), the windowing (24-CH in FIG. 4) and the weight addition (250 in FIG. 4). In contrast, according to the present invention these processes are executed in the order of the weight addition (13-1 and 13-2 in FIG. 2), the IMDCT (14-1, 14-2 and 15-2, 15-2 in FIG. 2) and the windowing (17-1 and 17-2 in FIG. 4). The IMDCT (22-CH and 23-CH in FIG. 4), the windowing (24-CH in FIG. 4) and the weight addition (250 in FIG. 4) are all linear transform processes. This means that respective of the change of the order in which these processes are executed as in the embodiment of the present invention (FIG. 2), the same decoded speech signals can be obtained as in the prior art case (FIG. 4).

Regarding the computational effort in the IMDCT, however, the process sequence according to the present invention and that in the prior art are quite different. In the prior art MDCT unit shown in FIG. 4, the 512- or 256-point IMDCT is executed one for each channel, i.e., a total of 5 times. Also, the windowing is executed once for each channel, i.e., a total of 5 times.

In contrast, in the IMDCT unit according to the present invention the 512- and 256-point IMDCTs are executed only twice in total for the single group of the 5 channels. The windowing are also executed only twice in total for the single group of the MAXCH channels. Besides, when the 512-point IMDCT is adopted for all the channels, the 2-nd weighting adding processor 13-2, the 1-st and 2-nd channel 256-point IMDCTs 15-1 and 15-2 and the 1-st and 2-nd channel adders 16-1 and 16-2 are unnecessary, and it is thus possible to further reduce the computational effort. Likewise, when the 256-point IMDCT is adopted for all the channels, the 1-st weighting adding processor 13-1, the 1-st and 2-nd 512-point IMDCTs 14-1 and 14-2 and the 1-st and 2-nd adders 16-1 and 16-2 are unnecessary, also permitting further computational effort reduction.

In the coded speech decoding system according to the present invention, the weighting adding process in the inverse mapping is executed in the frequency domain for each transform function. More specifically, the weighting adding process (13-1 and 13-2 in FIG. 2) on MDCT coefficients is executed for each transform function in lieu of the prior art weighting adding process (250 in FIG. 4) which is executed on time domain PCM audio signal. With the weighting adding process executed in the frequency domain, the number of channels used in the frequency domain signal can be reduced, thus permitting reduction of the number of times the inverse mapping transform and the windowing are executed.

As has been described in the foregoing, in the coded speech decoding system according to the present invention the weighting adding process is executed on MDCT coefficients and it is thus possible to reduce the computational effort in IMDCT in the inverse mapping transform and greatly reduce the number of times the IMDCT is executed.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A decoding system for converting an n-channel compressed audio signal to an m-channel decompressed audio signal where m<n, the n-channel compressed audio signal being in the frequency domain, and having been produced by applying one of a plurality of available mapping transforms separately to each channel of an n-channel time domain audio signal, the mapping transform applied to each channel having been selected according to the audio characteristics of the respective channels, the system being comprised of:

a first data processing circuit which is operable to perform a weighted addition computation on each of the n frequency domain audio channels to generate an m-channel frequency domain audio signal containing all of the audio information of the n-channel frequency domain audio signal;

a second data processing circuit which is operable to apply an inverse mapping transform separately to each of the m frequency domain audio channel signals to generate an m-channel time domain audio signal; and a third data processing circuit which performs a windowing process on the m-channel time domain audio signal.

2. A decoding system according to claim 1, wherein the first data processing circuit is operable to perform a weighted addition computation on each of the n frequency domain audio channel signals corresponding to each of the available mapping transforms.

3. A decoding system according to claim 1, wherein the first data processing circuit is operable to perform only the weighted addition computation on each of the n frequency domain audio channel signals corresponding to the available mapping transform used to produce the respective the frequency domain audio channel signal.

4. A decoding system according to claim 2, wherein the second data processing circuit is operable to perform an inverse mapping transform on each of the m frequency domain audio channel signals for each of the mapping transforms.

5. A decoding system according to claim 4, wherein the second data processing circuit performs an inverse mapping transform on each of the m frequency domain audio channel signals only for the ones of the available mapping transforms used to produce the n frequency domain audio channel signals.

6. The decoding system according to claim 1, wherein the first and second data processing circuits respectively perform the weighted addition process and the inverse mapping transform process only for those of the available mapping transforms actually used to create one of the n frequency domain audio signal channels.

7. A decoding system according to claim 1, wherein the second data processing circuit is operable to perform an inverse mapping transform on each of the m frequency domain audio channel signals for each of the mapping transforms.

8. A decoding system according to claim 7, wherein the second data processing circuit performs an inverse mapping transform on each of the m frequency domain audio channel signals only for the ones of the available mapping transforms used to produce the n frequency domain audio channel signals.

9. The decoding system according to claim 1, wherein the available mapping transforms are modified discrete cosine transforms, and wherein the second data processing circuit performs inverse modified discrete cosine transforms on the m-channel frequency domain audio signal.

10. The decoding system according to claim 1, wherein the available mapping transforms include a 256 point transform and a 512 point transform, and wherein the second data processing circuit performs a 256 point inverse transform and a 256 point inverse transform.

11. A method for converting an n-channel compressed audio signal to an m-channel decompressed audio signal where m<n, the n-channel compressed audio signal being in the frequency domain, and having been produced by applying one of a plurality of available mapping transforms separately to each channel of an n-channel time domain audio signal, the mapping transform applied to each channel having been selected according to the audio characteristics of the respective channels, comprising the steps of:

performing a weighted addition computation on each of the n frequency domain audio channels to generate an m-channel frequency domain audio signal containing all of the audio information of the n-channel frequency domain audio signal;

performing an inverse mapping transform separately on each of the m frequency domain audio channel signals to generate an m-channel time domain audio signal; and performing a windowing process on the m-channel time domain audio signal.

12. The method according to claim 11, wherein a weighted addition computation is performed on each of the n frequency domain audio channel signals for each of the available mapping transforms.

13. The method according to claim 11, wherein a weighted addition computation is performed on each of the n frequency domain audio channel signals only for the ones of the available mapping transforms used to produce the n frequency domain audio channel signals.

14. The method according to claim 12, wherein an inverse mapping transform is performed on each of the m frequency domain audio channel signals for each of the mapping transforms.

15. The method according to claim 12, wherein an inverse mapping transform is performed on each of the m frequency domain audio channel signals only for the ones of the available mapping transforms used to produce the n frequency domain audio channel signals.

16. The method according to claim 11, wherein weighted addition processes and inverse mapping transforms are performed only for those of the available mapping transforms actually used to create one of the n frequency domain audio signal channels.

17. The method according to claim 11, wherein an inverse mapping transform is performed on each of the m frequency domain audio channel signals for each of the mapping transforms.

18. The method according to claim 17, wherein an inverse mapping transform is performed on each of the m frequency domain audio channel signals only for the ones of the available mapping transforms used to produce the n frequency domain audio channel signals.

19. The method according to claim 11, wherein the available mapping transforms are modified discrete cosine transforms, and wherein the inverse mapping transforms are inverse modified discrete cosine transforms on the m-channel frequency domain audio signal.

20. The method according to claim 11, wherein the available mapping transforms include a 256 point transform and a 512 point transform, and wherein the inverse mapping transforms include a 256 point inverse transform and a 256 point inverse transform.

* * * * *